US006042124A

United States Patent [19]

Cheatham et al.

[11] Patent Number: 6,042,124

[45] **Date of Patent: *Mar. 28, 2000**

[54] IN-LINE SKATE HAVING ONE PIECE CHASSIS AND WHEEL SPACERS

[76] Inventors: James F. Cheatham, 2109 Via Alamitos, Palos Verdes, Calif. 90274; Fred Milne, 7071 Warner Ave. Suite 447, Huntington Beach, Calif. 92647; Orval L. Englebrecht, 1373 Midsite St., Covina, Calif. 91722

[ * ] Notice: This patent issued on a continued prosecution application filed under 37 CFR 1.53(d), and is subject to the twenty year patent term provisions of 35 U.S.C. 154(a)(2).

[21] Appl. No.: 08/902,449

[22] Filed: Jul. 29, 1997

[51] Int. Cl.[7] ..... A63C 17/06

[52] U.S. Cl. ..... 280/11.22; 280/11.19

[58] Field of Search ..... 280/11.22, 11.27, 280/11.23, 11.19, 842; 16/40, 45, 46

[56] References Cited

U.S. PATENT DOCUMENTS

| | | | |
|---|---|---|---|
| 687,838 | 12/1901 | Keiper | 16/45 |
| 1,410,676 | 3/1922 | Herold | 16/45 |
| 1,410,677 | 3/1922 | Herold | 16/45 |
| 2,125,292 | 8/1938 | Herold | 16/40 |
| 5,271,633 | 12/1993 | Hill, Jr. | 280/11.22 |
| 5,456,477 | 10/1995 | Bourdeau | 280/11.22 |
| 5,470,085 | 11/1995 | Meibock et al. | 280/11.22 |
| 5,470,086 | 11/1995 | Peterson et al. | 280/11.22 |
| 5,513,861 | 5/1996 | Monroy et al. | 280/11.22 |
| 5,533,740 | 7/1996 | Lin | 280/11.22 |
| 5,735,536 | 4/1998 | Myers et al. | 280/11.22 |
| 5,738,360 | 4/1998 | Petell et al. | 280/11.22 |
| 5,741,019 | 4/1998 | Lu | 280/11.22 |

OTHER PUBLICATIONS

Die Designing and Estimating, 4th Edition. Compiled and Edited by Watson N. Nordquist.

Tool and Manufacturing Engineers Handbook, 3rd Edition, Daniel B. Dallas, Editor–in–Chief.

*Primary Examiner*—J. J. Swann
*Assistant Examiner*—Frank Vanaman
*Attorney, Agent, or Firm*—Small Larkin, LLP

[57] ABSTRACT

A skate chassis formed from one piece of metal by a stamping process.

13 Claims, 10 Drawing Sheets

IN-LINE SKATE HAVING ONE PIECE CHASSIS AND WHEEL SPACERS

BACKGROUND

1. Field of the Invention

This invention is directed to chassis for skates, in general, and to a chassis stamped and formed from a single piece of metal for in-line roller skates, in particular.

2. Prior Art

Roller skates and ice skates have been known for many years.

A recent innovation in roller skates is referred to as in-line skates wherein the wheels or rollers are arranged in-line one behind the other, typically, in groups of four. This arrangement creates a type of footwear which is more akin to an ice skate, than to a conventional roller skate. As a result, roller hockey has become a popular hobby, pastime and even professional sports activity.

The typical in-line skate includes a shoe or boot and an attached metal chassis for supporting the rollers. In the past, the metal chassis has been formed by machining a single block of metal to form the desired shape. Alternatively, the frame has been constructed by welding multiple pieces of metal together to form the frame. Of course, these chassis and methods of manufacture have been quite expensive wherein the skates become expensive.

SUMMARY OF THE INSTANT INVENTION

This invention is directed to a skate chassis including sole and heel flanges, which is formed of a single piece of material, typically metal blank stock, which is operated upon in a multiple step, stamping process. This process can include a progressive die technique. The blank stock is pierced, punched, formed, coined, and folded in various steps until a one piece chassis is produced.

Spacers for supporting axles and spacing wheels on the axles are integrally formed in the chassis during the coining (or extruding) operation.

Optional welding steps can be utilized in order to establish connections between strength imparting braces formed in the chassis.

DESCRIPTION OF A PREFERRED EMBODIMENT

Figure 1:
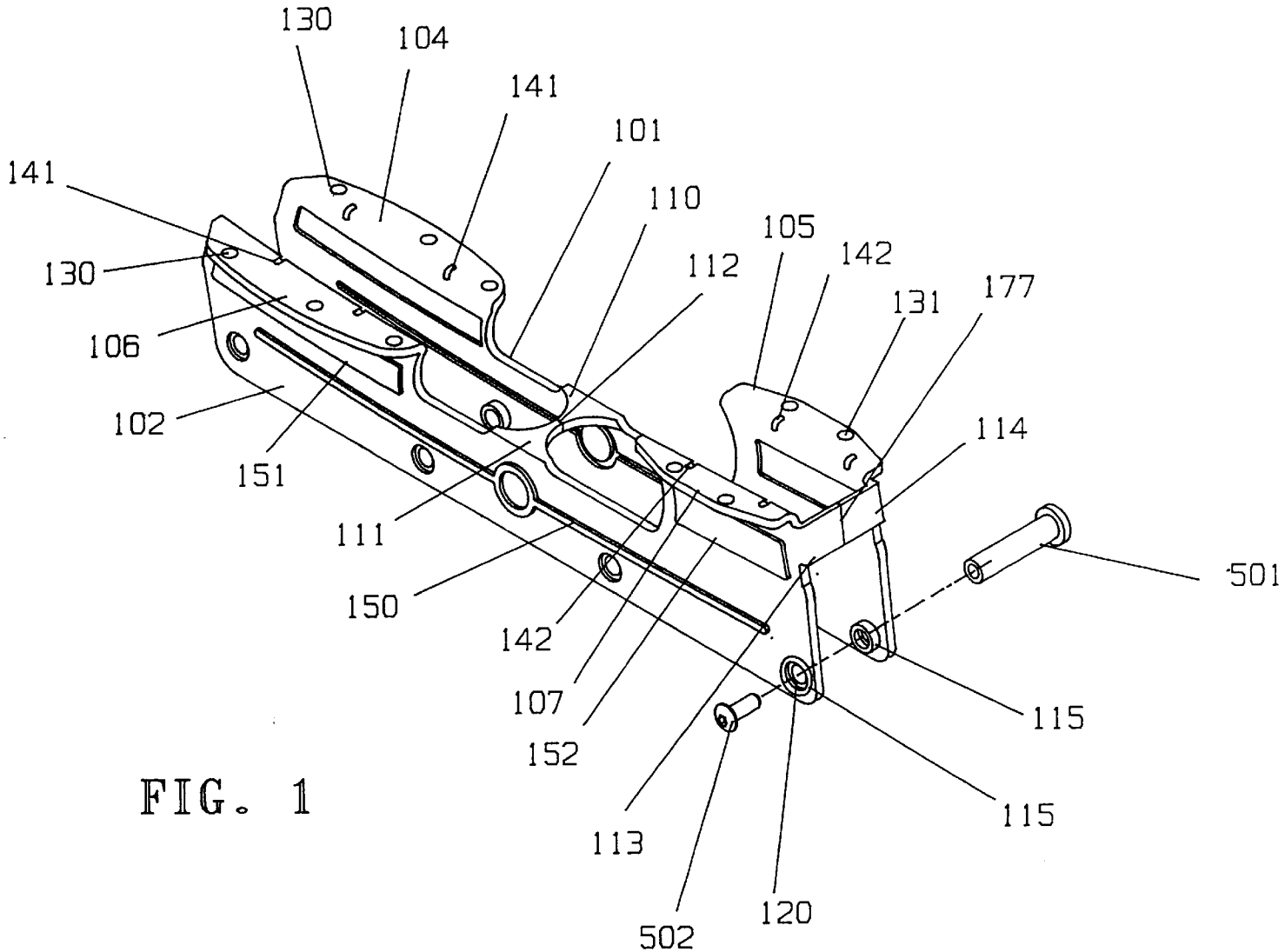
FIGS. 1 and 1A are perspective views of a skate chassis produced in accordance with the instant invention.
Figure 1A:
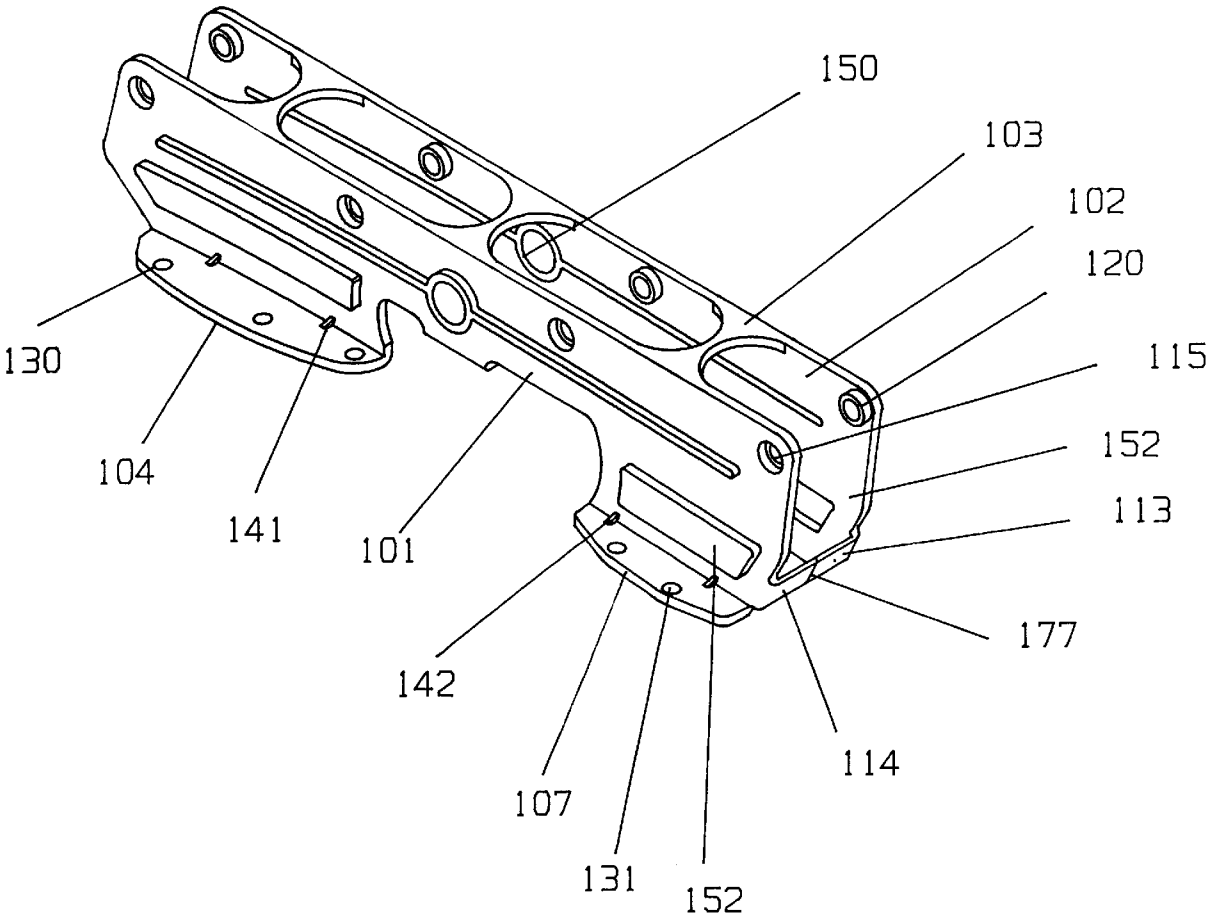

Referring now to FIG. 1, there is shown a perspective view of a skate chassis 100 produced in accordance with the instant invention. In particular, the skate chassis is preferrably designed for the so-called "in-line" skate which supports a plurality of skate wheels (W, seen in FIG 2. ) which are aligned behind each other in a single line.

The chassis 100 comprises a pair of spaced apart, substantially parallel sides 101 and 102. The sides are integrally formed with a bottom 103. A front or sole mounting flange 104 and a rear or heel mounting flange 105 is integrally formed with side 101. Complementary mounting flanges 106 and 107 are integrally formed with side 102. The complementary flanges extend outwardly from the respective sides.

One or more support braces 110 and 111 can be integrally formed with the respective sides 101 and 102. Similar braces 113 and 114 are formed at the rear of the chassis. In a preferred embodiment, the support braces can be welded together at a joint 112. Braces 113 and 114 can be welded, as well, as described hereinafter.

A plurality of axle spacers 115 are formed on the inner surface of each of the sides 101 and 102, respectively. The axle support holes 120 are formed, at least to some degree, axially through the spacers 115. Thus, the number of spacers 115 is dictated by the number of axles to be supported in the chassis 100.

Typically, the spacers 115 are extruded from the side material. (This process is sometimes referred to as coining.) The technique of forming the spacers 115 integrally with the sides of the chassis avoids the multi-part, multi-step process used in the prior art wherein separate spacers are inserted into the axle support holes 120 in the chassis.

The chassis 100 includes a plurality of apertures or holes 130 and 131 in the sole and heal mounting flanges 104, 106 and 105, 107, respectively, for receiving fasteners (e.g. rivets, bolts or the like) used to mount a shoe or a boot B to the chassis 100. Embossments 150 and 151 can be included in the chassis for cosmetic and/or strengthening purposes.

Figure 2:
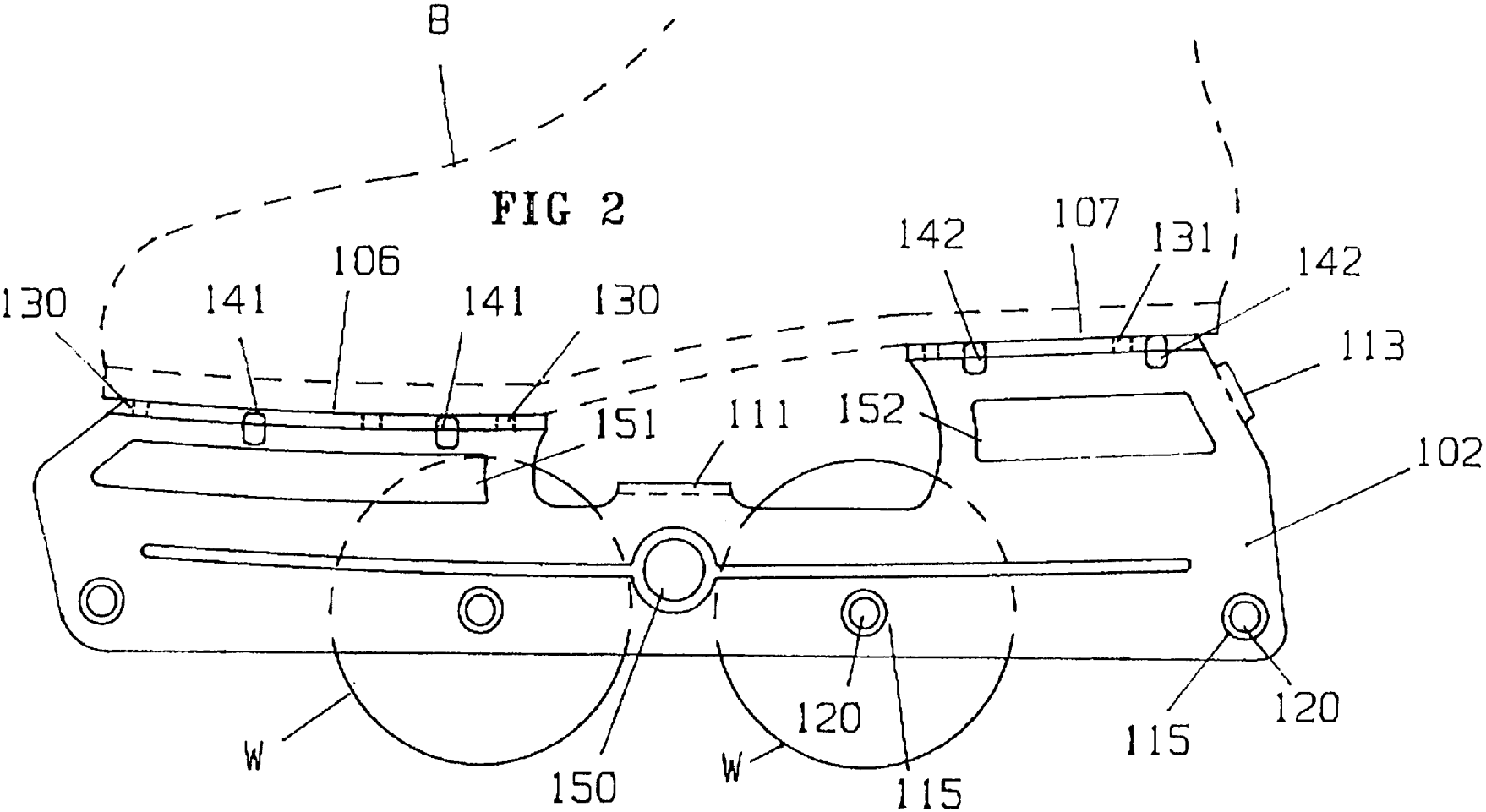
FIG. 2 is a side elevation view of a skate chassis produced in accordance with the instant invention.

Referring now to FIG. 2, there is shown a side elevation view of a skate chassis 100 produced in accordance with the instant invention. In this view, the side 102 is depicted. (Side 101, seen in FIG. 1, is similarity configured.) The rear of the skate chassis is shown on the right in FIG. 2. The heel support flange 107 is integrally formed at the top rear edge of side 102. The sole support flange 106 is integrally formed at the top, front edge of side 102.

The support brace 111 is integrally formed at the top, middle edge of side 102. A complementary support brace 110 is formed with side 101 as shown in FIG. 1. It is contemplated that support brace 110 or 111 can be appropriately dimensioned to fully extend between sides 101 and 102. However, in the preferred embodiment, support braces 110 and 111 are about equal in dimensions and are welded together in joint 112 at the ends thereof about midway between sides 101 and 102.

The support brace 113 is integrally formed at the top, back edge of side 102. A complementary support brace 114 is formed with side 101 as shown in FIG. 1. It is contemplated that support brace 114 or 113 can be appropriately dimensioned to fully extend between sides 101 and 102. However, in the preferred embodiment, support braces 114 and 113 are about equal in dimensions and are welded together in joint 177 at the ends thereof about midway between sides 101 and 102.

Embossments 150, 151 and 152 are shown in FIG. 2. The number, placement and configuration of these embossments can be varied as desired. One or more of the embossments may be omitted, if desired. The embossments are intended to provide strengthening (as well as esthetic) characteristics to the chassis 100 but the specific design is not critical.

The apertures 130 and 131 are provided through the flanges 106 and 107, respectively. Appropriate fasteners, such as rivets, screws or the like (not shown), are passed through these apertures to fasten a shoe or boot (B) to the chassis 100.

In addition, one or more gussets 141 are formed between flange 106 and side 102. Similarly, gussets 142 are formed between flange 107 and side 102. The gussets are used in order to provide additional strength for the chassis. Of course, similar gussets are provided on the other side of the chassis as well.

The spacers 115 ace formed in the side 102 by extruding or coining, as noted supra. The spacers are, in effect, small truncated conically shaped projections which extend inwardly toward the center of the chassis and are located on the opposite surface of side 102. The apertures 120 are axially formed in the spacers 115 and are adapted to receive the wheel supports or axles in the assembly of the skate.

Figure 3:
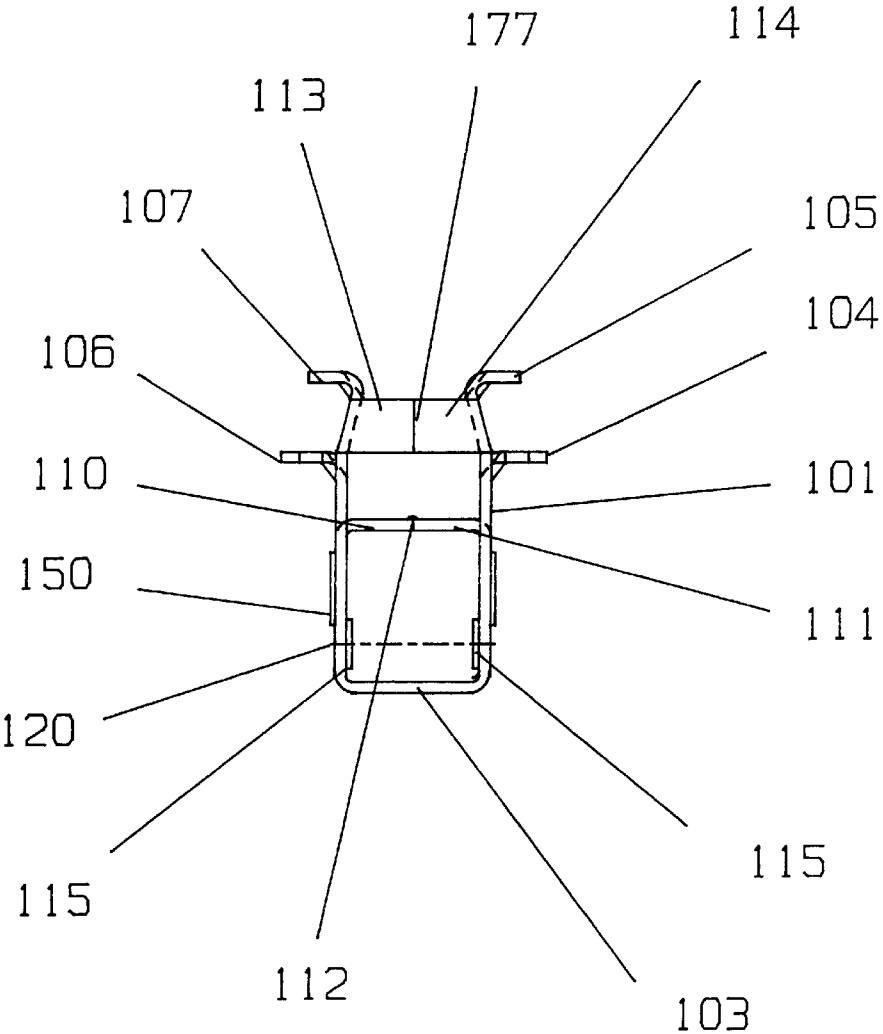
FIG. 3 is a front end elevation view of a skate chassis produced in accordance with the instant invention.

Referring now to FIG. 3, there is shown a back end elevation view of the chassis 100. In this case, the back end is consistent with the right end of the chassis 100 as shown in FIG. 1.

The view in FIG. 3 shows the sides spaced apart but integrally formed with bottom 103. The support braces 110 and 111 are integrally formed with sides 101 and 102, respectively. The braces 110 and 111 are bent toward each other and, preferrably, joined together in a welded joint 112.

The rear flanges 105 and 107, as well as the front flanges 104 and 106, are formed integrally with sides 101 and 102, respectively. The flanges are bent outwardly relative to the sides in this embodiment.

In this embodiment, the upper ends 101A and 102A of sides 101 and 102, respectively, are bent inwardly toward each other to form an "A-frame" style chassis. Support brackets 113 and 114 are joined together at a welded joint 177. The upper ends of the sides are bent together as shown in FIG. 3 to provide one style of frame.

The spacers 115 extend inwardly relative to the sides 101 and 102. The spacers assist in the proper spacing of the skate wheels when they are assembled with the chassis.

Figure 4:
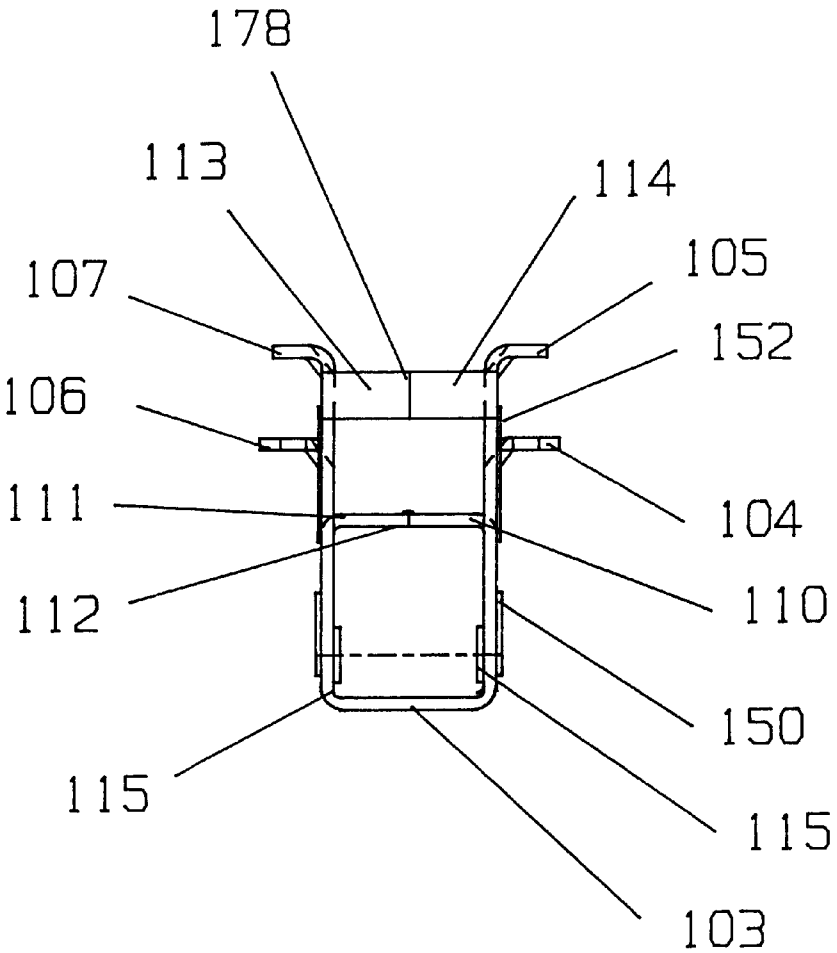
FIG. 4 is a back end elevation view of a skate chassis produced in accordance with the instant invention.

Referring now to FIG. 4, there is shown a back end elevation view of another embodiment of the chassis 100. In this case, the back end is consistent with the right end of the chassis 100 as shown in FIG. 2.

The view in FIG. 4 shows the sides 101 and 102 spaced apart but integrally formed with bottom 103. The support braces 110 and 111 are integrally formed with sides 101 and 102, respectively. The braces 110 and 111 are bent toward each other and, preferrably, joined together in a welded joint 112.

The rear flanges 105 and 107, as well as the front flanges 104 and 106, are formed integrally with sides 101 and 102, respectively. The flanges are bent outwardly relative to the sides in the preferred embodiment.

In this embodiment, the sides 101 and 102, respectively, are substantially parallel to each other and for the "square-frame" style chassis. Support brackets 113 and 114 are joined together at a welded joint shown at 177 in FIG. 3 and at 178 in FIG. 4. This style of frame and the A-frame style shown in FIG. 3 are two examples of frame configuration. Other configurations are also contemplated even though not specifically shown and/or described herein.

The spacers 115 extend inwardly relative to the sides 101 and 102. The spacers assist in the proper spacing of the skate wheels when they are assembled with the chassis.

Figure 5:
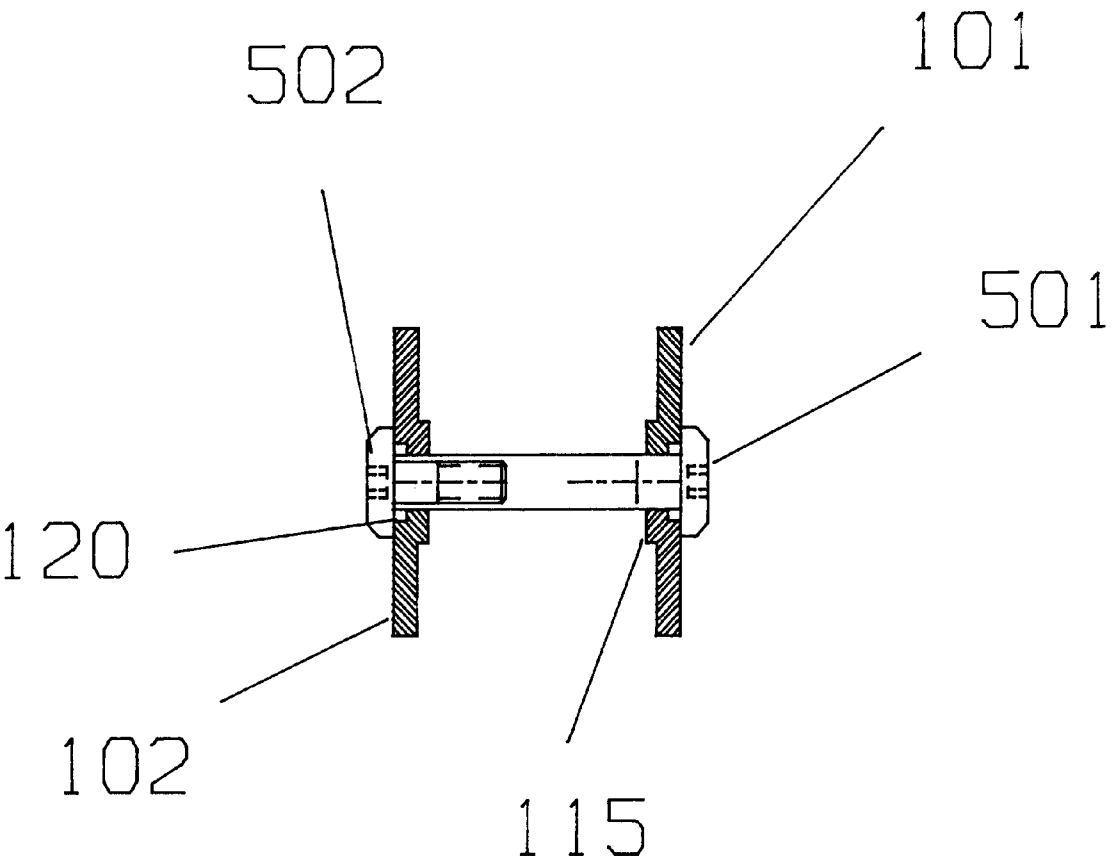
FIG. 5 is a detail view of the coined or extruded spacer provided in a skate chassis produced in accordance with the instant invention.

Referring now to FIG. 5, there is shown a detailed view of a spacer 115. As described supra, each spacer 115 is extruded or coined in the side 101 or 102 as appropriate. In particular, the spacer 115 takes a generally truncated conical configuration of material on the inner surface of the relative side. The spacer 115 defined to include a flat, annular surface 503 and central axial aperture 120 which has the appropriate diameter to engage and/or interact with the axle 501, which supports the skate wheel when the skate is assembled. Typically, the spacer is, effectively, countersunk on the exterior of the respective chassis side. The countersunk configuration can be advantageously used to accommodate a flat head screw 502 (and/or axle 501) in order to provide a smooth exterior surface for the assembled skate. Of course, carriage bolts or screws with other head configurations can be used, if desired.

Figure 6:
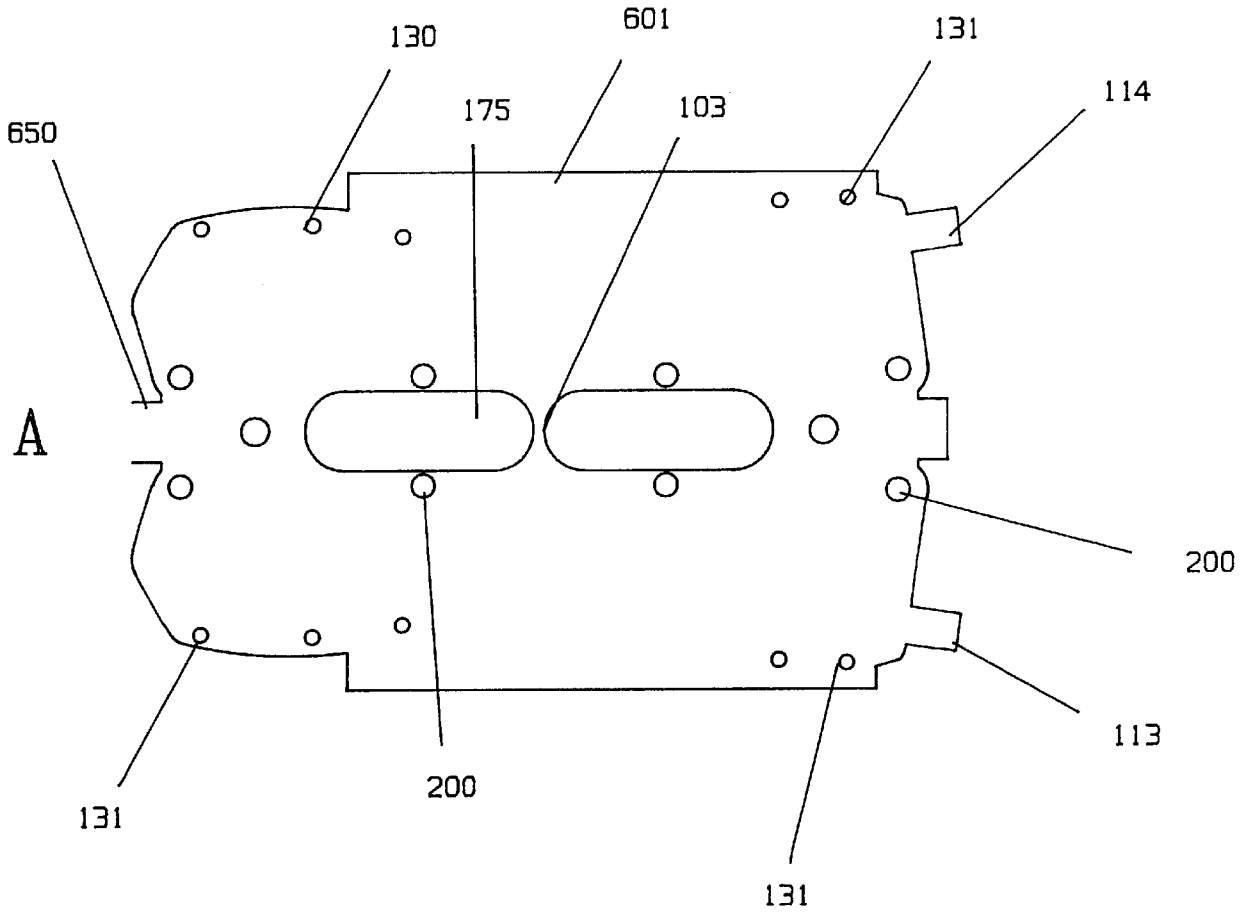
FIGS. 6*a*–6*c* plan views of a representative formation of a skate chassis from a single piece of metal blank stock.
Figure 6:
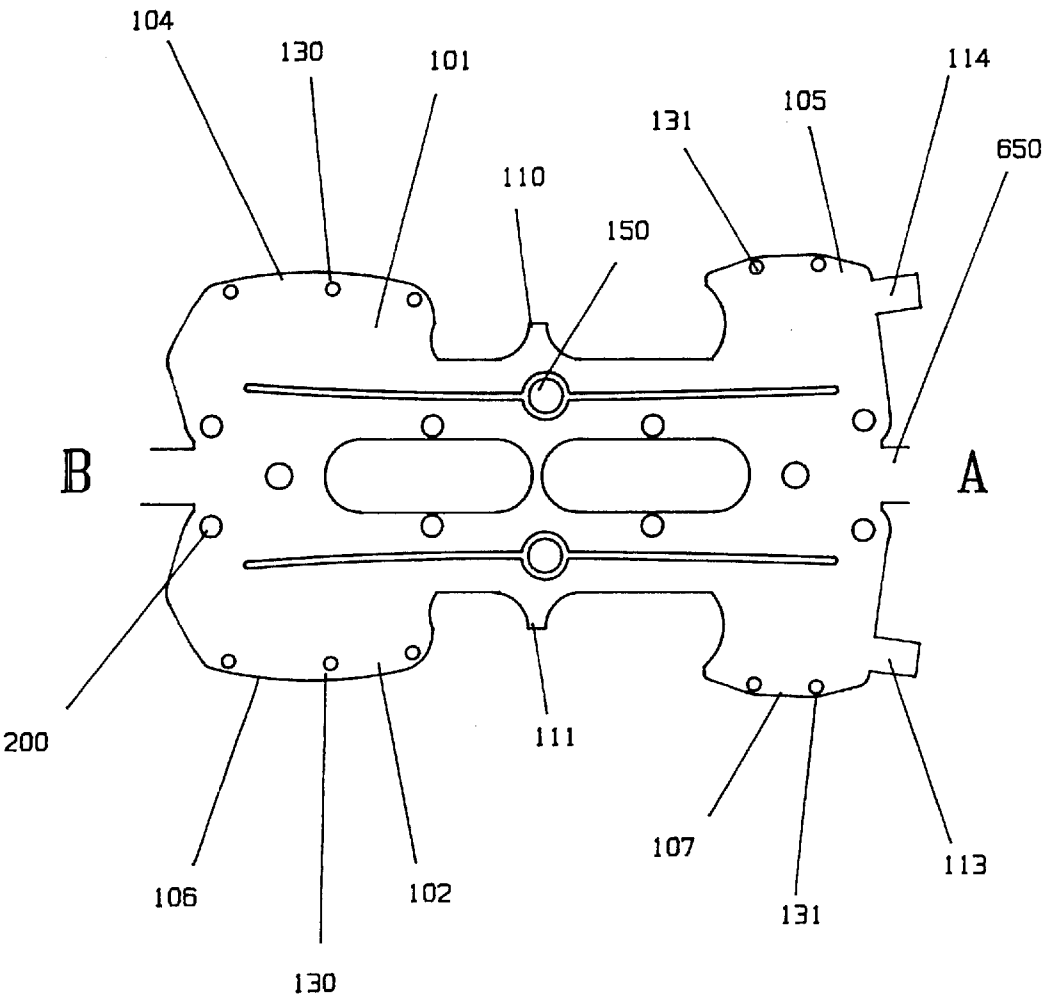
Figure 6:
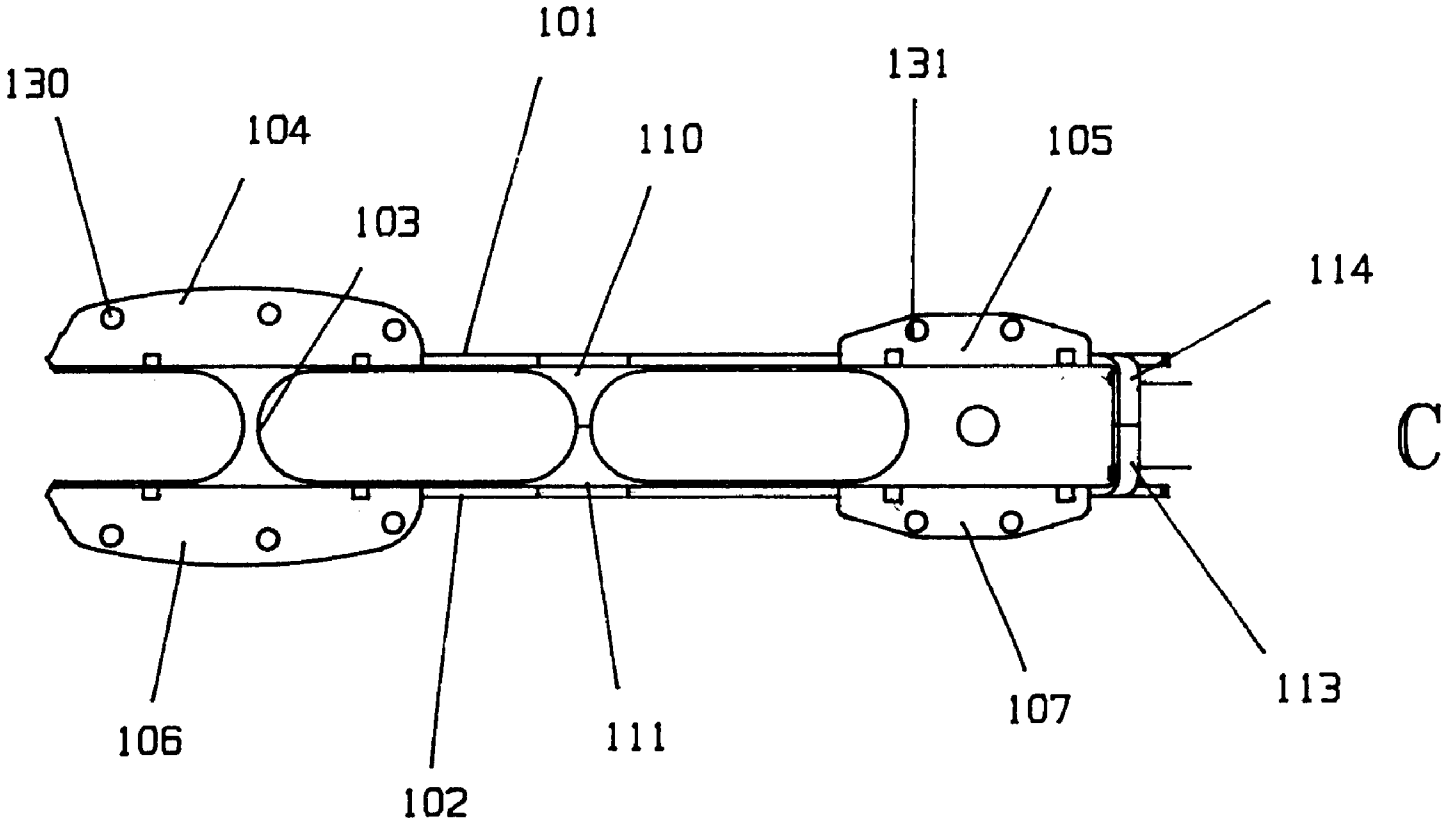
Figure 6:
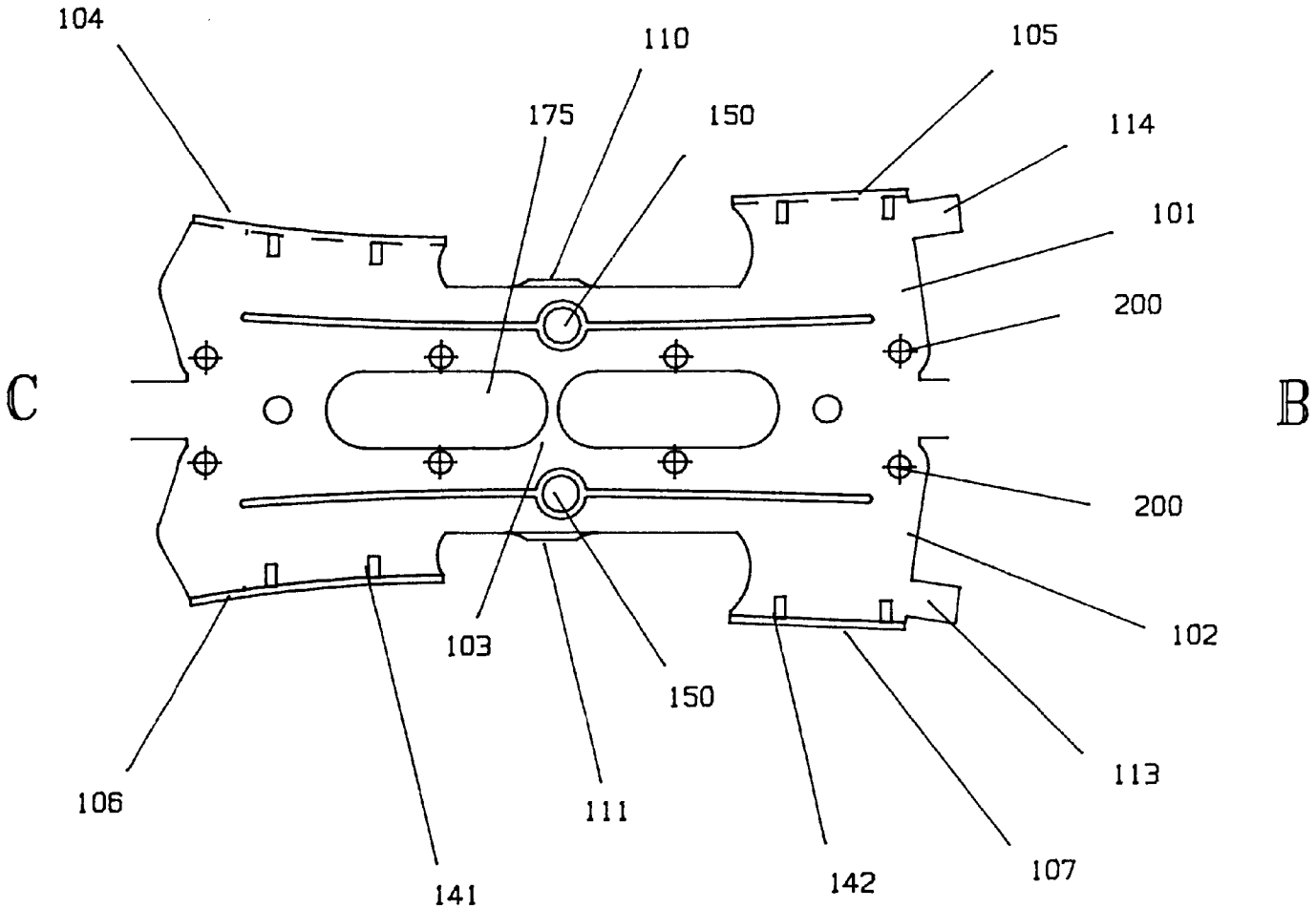

Referring now to FIG. 6, there is shown a representative process for forming the one piece skate chassis 100. In this embodiment, the input material or blank is in the form of rolls or sheets of metal, i.e. aluminum, stainless steel, or the like, about 10 to 12 inches wide and about ⅛" thick.

The blank stock 600 is fed into the stamping and forming apparatus (not shown) where it is stamped, cut and formed. The process can take several discrete steps and/or it can be accomplished by use of a progressive die. Typically, in the first step, i.e. Step 1, the general outline of the chassis is formed. Also a plurality of relatively small holes 130, 131 are punched through the blank 601. These holes become the mounting holes for receiving the rivets or other fasteners for securing a boot or a shoe to the completed frame as described above.

Likewise, several (typically eight) axle holes 200, arranged in pairs, are punched through the blank. These holes are used to receive the axles for the wheels of the assembled skate.

Also, several large holes 175 or cutouts are punched through the blank 601 adjacent to and intermediate related pairs of axle holes 200. The holes or cutouts 175 are used to form the openings through which the wheels of the assembled skate protrude, with the remaining material shown at 103.

Some or all of the cuts and stampings can be accomplished concurrently. That is, the various stamping procedures can be accomplished in one or several steps depending upon the type of stamping equipment utilized. For example, the shape of the front and back ends of the sides 101 and 102 can be formed at Step 1.

In another step such as Step 2, embossments 150 can be made in the blank 602 adjacent to the axle holes 200. These areas of the blank will become the sides 101 and 102 of the assembled frame. These embossments can take any shape or configuration desired. The embossments are, generally, intended to provide strengthening characteristics by including ribs, grooves, ridges or the like. The shapes of the embossments can be circular, rectilinear, elongated ribs or the like to form a desired configuration and can provide design advantages.

In addition, at a convenient time in the process, for example during Step 2, the axle holes 200 are extruded, coined or otherwise formed into short, truncated cylinders or cones 115 which extend from the surface of the blank. These cones or cylinders will ultimately be disposed within the formed chassis and provide integrally formed spacers for locating the wheels within the assembled skate.

Once the desired shape has been stamped and/or punched into the blank, the forming of the chassis 100 is initiated.

The forming process, as shown in Step 3, typically, begins with a wiping or forming operation wherein the spacer tabs 110 and 111 are bent upward and the boot support flanges 104–107 are bent downward. (Of course, these directions are relative so long as the bends place the respective components in the proper position for the finalized chassis configuration.)

In Step 4, the sides of the chassis 101 and 102 are formed by bending or folding them upward relative to the blank. This operation forms a generally U-shaped channel comprising the sides 101 and 102 along with the bottom 103. At this time the spacer tabs 110 and 111 are formed toward each other and the support flanges 104–107 are bent away from each other. (Of course, it is contemplated that in some embodiments, the flanges 104–107 may extend toward each other.) Once the folding or bending has been accomplished, the related spacer tabs 110 and 111, as well as spacers 113 and 114, can be welded together to form a secure, sturdy support structure. The spacer tabs 110, 111, 113 and 114 operate to provide rigidity to the U-shaped chassis. The tabs (or braces) keep the sides spaced apart and also joined together.

In the event that the process was conducted as a series of steps on a single sheet or a roll of material with a plurality of blanks joined together by a connector tongue 650 as shown in FIG. 6, for example, the blanks will be separated. The separation usually occurs prior to the welding step, if appropriate.

Likewise, the axles and wheels are assembled to the chassis. Thereafter, the shoes or boots are also assembled to the chassis. At this juncture, an in-line skate with a strong, reliable chassis is completed. The chassis is relatively inexpensive to fabricate whereby the costs of making the in-line skates is reduced.

Thus, there is shown and described a unique design and concept of one piece skate chassis. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. A one piece chassis comprising:

one piece of metal formed to include;

a channel having a top, a bottom and a pair of sides;

a plurality of flanges positioned at the top of said channel and adapted for attachment of footwear; and a plurality of holes positioned in said pair of sides and adapted to receive axles for skate wheels; and predetermined regions of said one piece of metal later formed to include coined spacers surrounding each of said plurality of holes.

2. The chassis recited in claim 1 further including flat, annular surfaces on said coined spacers.

3. The chassis recited in claim 1 wherein said sides are substantially parallel to each other.

4. The chassis recited in claim 1 wherein said sides are inclined toward each other adjacent said top.

5. The chassis recited in claim 1 further including;

at least one support brace extending from at least one of said sides, attached to the other one of said sides, and adapted to provide rigidity to said chassis.

6. The chassis recited in claim 1 further including at least one embossment in at least one of said sides.

7. The chassis recited in claim 1 further including at least one gusset formed between each flange and the associated one of said sides.

8. An in-line skate having a chassis formed from a single piece of metal comprising:

a chassis having a top portion, a bottom portion and two sides extending in a length direction;

footwear mounted to the top portion of the chassis;

a plurality of apertures formed and positioned in the bottom portion of the chassis along its length direction;

projections coined from said bottom portion of said single piece of metal surrounding said apertures and that extend from each side of the chassis toward the opposite side of the chassis; and a plurality of wheels and axles rotatably mounted in the apertures and spaced between the two sides of the chassis by the projections.

9. An in-line skate chassis formed from a single piece of metal comprising;

a pair of sides including a first side, and a second side rigidly positioned substantially parallel to the first side;

a first plurality of apertures formed in the first side and a second plurality of apertures formed in the second side;

a first plurality of spacers coined from the first side and extending from the first side toward the second side; and a second plurality of spacers coined from the second side and extending from the second side toward the first side.

10. The in-line skate chassis of claim 9 further including at least one embossment in at least one of said sides.

11. An in-line skate comprising:

a chassis, formed from a single piece of metal a plurality of wheels and axles rotatably mounted to a bottom part of the chassis, and footwear mounted on a top part of the chassis;

the chassis including a first side extending along a first direction and a second side extending in a direction substantially parallel to the first;

the first side including a plurality of first side holes formed in its bottom part;

said first side holes being surrounded by a plurality of spacers coined from the first side and extending in a direction toward the second side;

the second side including a plurality of second side holes formed in its bottom part;

said second side holes being surrounded by a plurality of spacers coined from the second side and extending in a direction toward the first side;

said axles extending through said holes in said first side and said second side; and said wheels mounted on said axles and spaced between said sides by said spacers.

12. The in-line skate of claim 11 further including at least one embossment in the first side; and at least one embossment in the second side.

13. A method of making an in-line skate comprising:

providing a single piece of metal suitable for forming forming said piece of metal into a skate chassis having a top portion, a bottom portion and two sides extending in a length direction;

forming a plurality of apertures in the bottom portion of the chassis along its length direction;

coining a plurality of annular projections from said piece of metal in areas surrounding said apertures to form a plurality of spacers extending from each side of the chassis toward the opposite side of the chassis;

rotatably mounting a plurality of wheels on axles extending through the apertures; and mounting footwear to the top portion of the chassis.

* * * * *